US011846302B2

(12) United States Patent
McDonnell

(10) Patent No.: US 11,846,302 B2
(45) Date of Patent: Dec. 19, 2023

(54) FAN WITH FIRST SUBSET OF LOUVERS AND SECOND SUBSET OF LOUVERS

(71) Applicant: Joseph A. McDonnell, Miramar, FL (US)

(72) Inventor: Joseph A. McDonnell, Miramar, FL (US)

( * ) Notice: Subject to any disclaimer, the term of this patent is extended or adjusted under 35 U.S.C. 154(b) by 31 days.

(21) Appl. No.: 17/479,312

(22) Filed: Sep. 20, 2021

(65) Prior Publication Data

US 2022/0003244 A1 Jan. 6, 2022

Related U.S. Application Data

(62) Division of application No. 14/735,457, filed on Jun. 10, 2015, now abandoned.

(60) Provisional application No. 62/010,236, filed on Jun. 10, 2014.

(51) Int. Cl.

| | |
|---|---|
| ***F04D 29/70*** | (2006.01) |
| ***F04D 29/64*** | (2006.01) |
| ***F04D 19/00*** | (2006.01) |

(52) U.S. Cl.

CPC ..... *F04D 29/644* (2013.01); *F04D 19/002* (2013.01); *F04D 29/703* (2013.01); *Y10T 29/49329* (2015.01)

(58) Field of Classification Search

CPC ..... F04D 29/644; F04D 19/002; F04D 29/703
See application file for complete search history.

(56) References Cited

U.S. PATENT DOCUMENTS

| | | | | |
|---|---|---|---|---|
| 2,824,429 | A | 2/1958 | Zucker | |
| 2,936,109 | A | 5/1960 | Copeland | |
| 3,481,534 | A * | 12/1969 | Price | F04D 25/10 415/146 |
| 4,084,491 | A | 4/1978 | Spotts et al. | |
| 4,120,615 | A * | 10/1978 | Keem | F04D 29/526 D23/370 |
| 4,189,284 | A | 2/1980 | Cummins | |
| 4,341,151 | A * | 7/1982 | Sakamoto | F24F 7/013 D23/382 |
| 4,350,472 | A * | 9/1982 | Morimoto | F04D 29/646 415/125 |
| 4,365,930 | A | 12/1982 | Ogura et al. | |
| 4,457,672 | A | 7/1984 | Ogura et al. | |
| 4,486,144 | A * | 12/1984 | Hung | F04D 25/10 415/125 |

(Continued)

*Primary Examiner* — Aaron R Eastman
(74) *Attorney, Agent, or Firm* — Harness, Dickey & Pierce, P.L.C.

(57) ABSTRACT

The fan includes a fan frame, blades positioned inside the fan frame, a grill frame on a side of the fan frame, a centerline of the grill frame traversing through a midpoint of the grill frame, a first motor configured to rotate the blades to produce an air flow in a first direction through the grill frame, the first direction being parallel to a centerline of the grill frame, a second motor configured to rotate the grill frame within the fan frame, a plurality of louvers affixed within the grill frame, the plurality of louvers including a first subset of louvers and a second subset of louvers, the first subset of louvers possessing no offset angle relative an angle of the centerline, each one of the second subset of louvers being angled toward a first side of the grill frame due to the at least one first offset angle.

20 Claims, 14 Drawing Sheets

(56) References Cited

U.S. PATENT DOCUMENTS

| | | | | |
|---|---|---|---|---|
| 4,515,538 | A * | 5/1985 | Shih | F04D 25/10 416/246 |
| 4,521,153 | A * | 6/1985 | Morimoto | F04D 25/105 454/258 |
| 4,642,441 | A * | 2/1987 | Kenyon | G05D 23/24 454/313 |
| 4,838,151 | A | 6/1989 | Shin-Chin | |
| 6,364,618 | B1 | 4/2002 | Moreno | |
| 6,939,105 | B2 * | 9/2005 | Horng | F04D 29/544 415/206 |
| 9,574,569 | B2 | 2/2017 | Chang et al. | |
| 2005/0063822 | A1 * | 3/2005 | Horng | F04D 29/541 257/E23.099 |
| 2006/0067818 | A1 * | 3/2006 | Studebaker | E04B 1/7092 415/198.1 |
| 2008/0108296 | A1 | 5/2008 | Rimmer et al. | |
| 2008/0170940 | A1 | 7/2008 | Wu et al. | |

* cited by examiner

FAN WITH FIRST SUBSET OF LOUVERS AND SECOND SUBSET OF LOUVERS

PRIORITY STATEMENT

This application is a divisional of U.S. application Ser. No. 14/735,457, filed on Jun. 10, 2015, which is a non-provisional application that claims priority to U.S. Provisional Application No. 62/010,236, filed on Jun. 10, 2014, the entire contents of each which are incorporated by reference in their entirety.

BACKGROUND OF THE INVENTION

Field of the Invention

Example embodiments relate generally to a fan grill (and a fan utilizing the fan grill) able to produce a multi-directional air current. More particularly, example embodiments relate to a method and apparatus for a fan grill (and a fan utilizing the fan grill) able to produce a cone or a vortex-shaped air current.

Related Art

As shown in FIG. 1, conventional fans generally produce a cylindrically-shaped flow of air. Such a conventional fan may also spread air throughout a room by being able to oscillate the blades of a fan on an axis. However, these oscillating fans are not entirely effective at filling a room with circulating air, for several reasons. First, it takes some amount of time for the fan to oscillate the blades in different directions. Second, because the air flow produced by the fan is limited to a generally cylindrical-shape, at any period of time the fan is only capable of blowing air in the direction that the blades are facing (even given that the fan may oscillate). Third, because the air flow produced by the fan is limited to a generally cylindrical-shape, the fan will not offer air current in regions that are located above or below the approximate elevation of the fan blades, even if the fan does oscillate.

SUMMARY OF INVENTION

Example embodiments provide a method and apparatus for a fan grill, and a fan that may utilize the grill, that may produce an air flow current in the shape of a cone or a vortex in order to significantly increase air circulation in a room. In particular, the fan grill may act to produce air flow currents that spread out across the sides of fan blades that drive air through the fan grill. The fan grill may also act to produce air flow currents at elevations that are significantly above and below an elevation of the fan blades, themselves. The fan may also rotate the fan grill, clockwise and/or counter-clockwise, in a plane that is about perpendicular to a direction of air flow that is leaving the fans blades.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1:
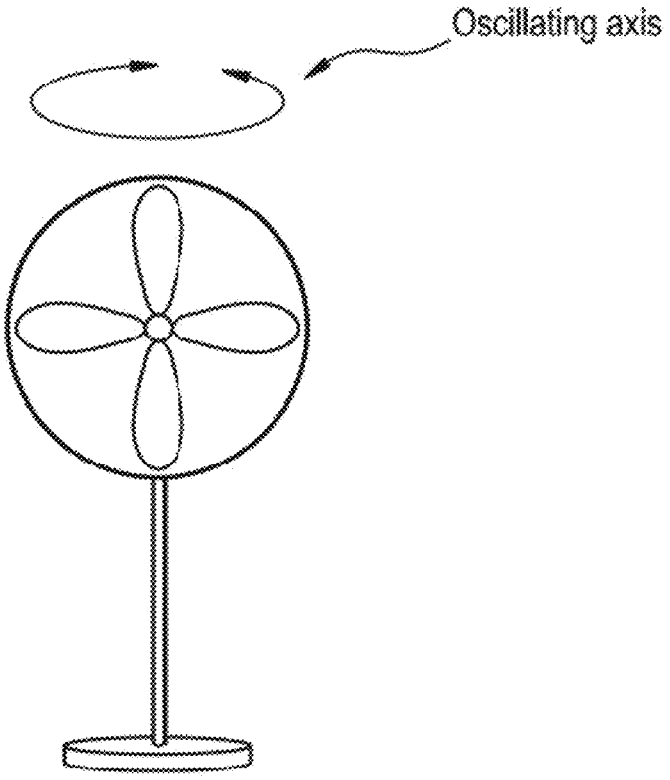
FIG. 1 is a conventional oscillating fan.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 2:
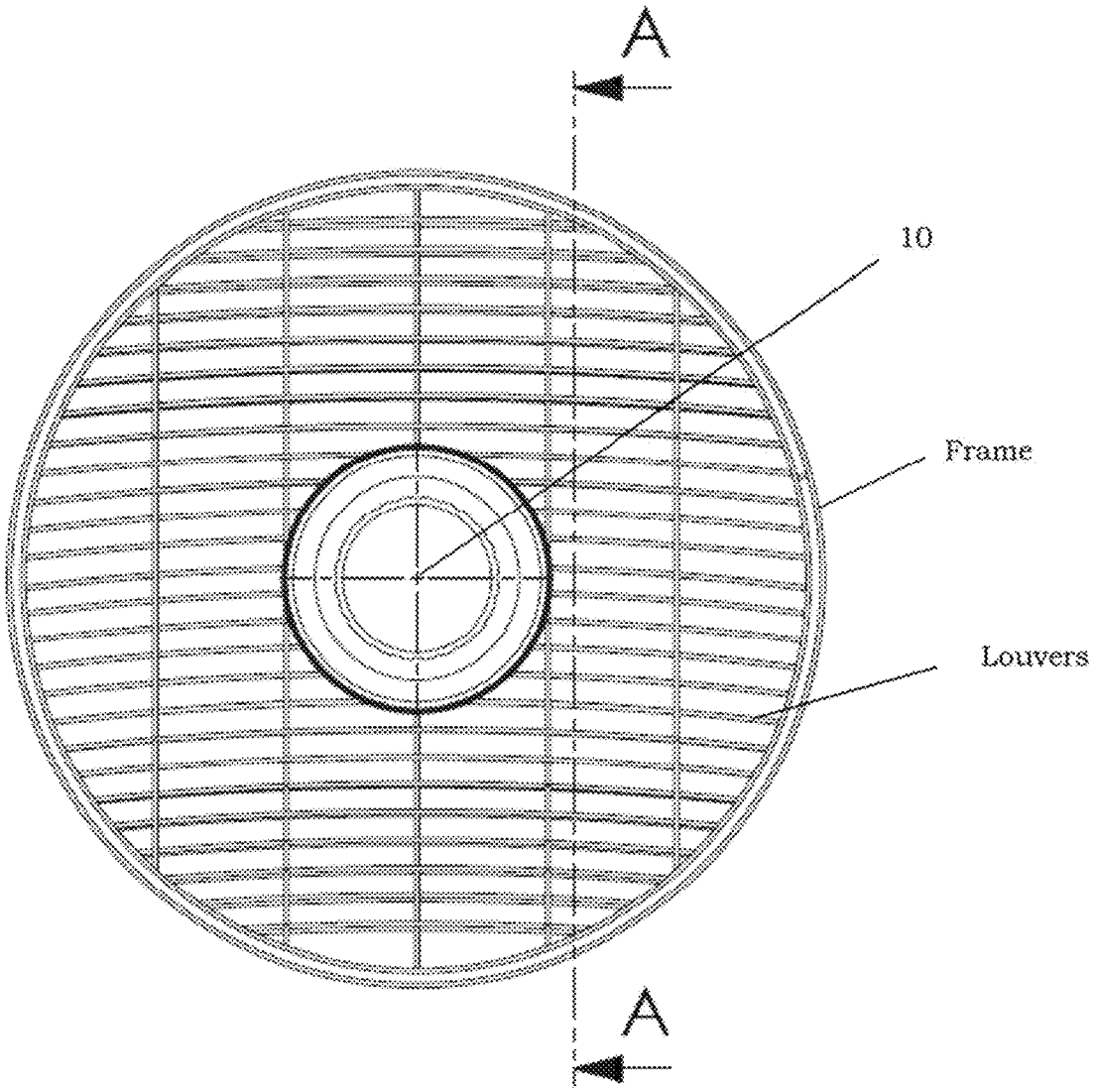
FIG. 2 is a front view of a fan grill, in accordance with an example embodiment.

FIG. 2 is a front view of a fan grill, in accordance with an example embodiment. The grill may include a frame. The frame may be circular, square, or any other shape. Louvers may be affixed within the frame. A 'centerline' 10 of the grill frame is shown in FIG. 2, traversing through a midpoint (in this case, an epicenter) of the grill frame.

Figure 3:
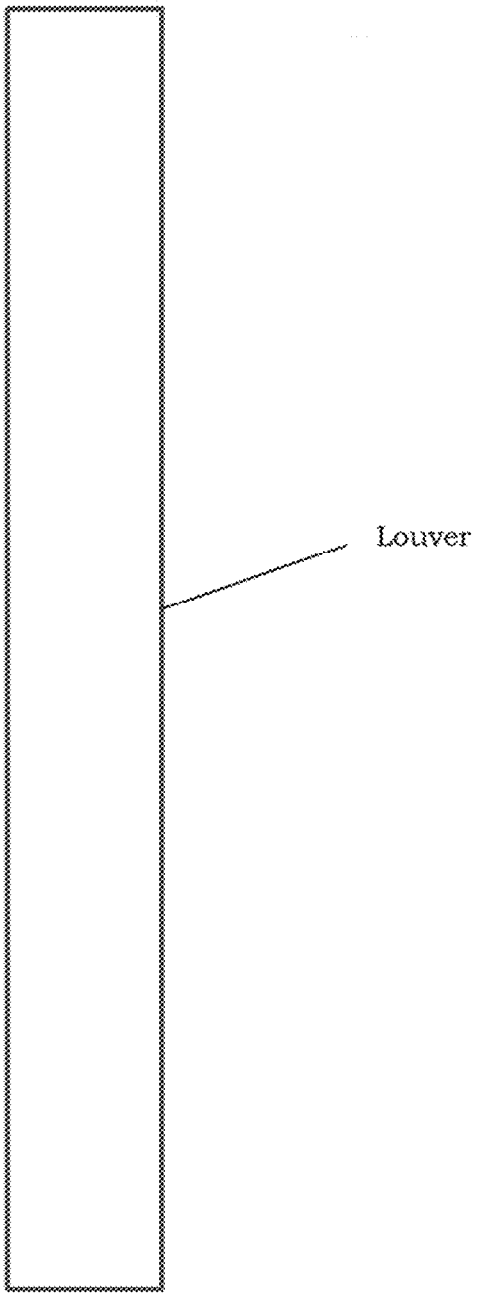
FIG. 3 is a top view of a louver of the fan grill of FIG. 2, in accordance with an example embodiment.

FIG. 3 is a top view of a louver of the fan grill of FIG. 2, in accordance with an example embodiment. The louver may be strip with major surfaces (FIG. 2 shows a top surface). The louver may be somewhat rectangular in shape, though other shapes may be used as long as the louver offers major surfaces to direct a flow of air through the grill.

Figure 4:
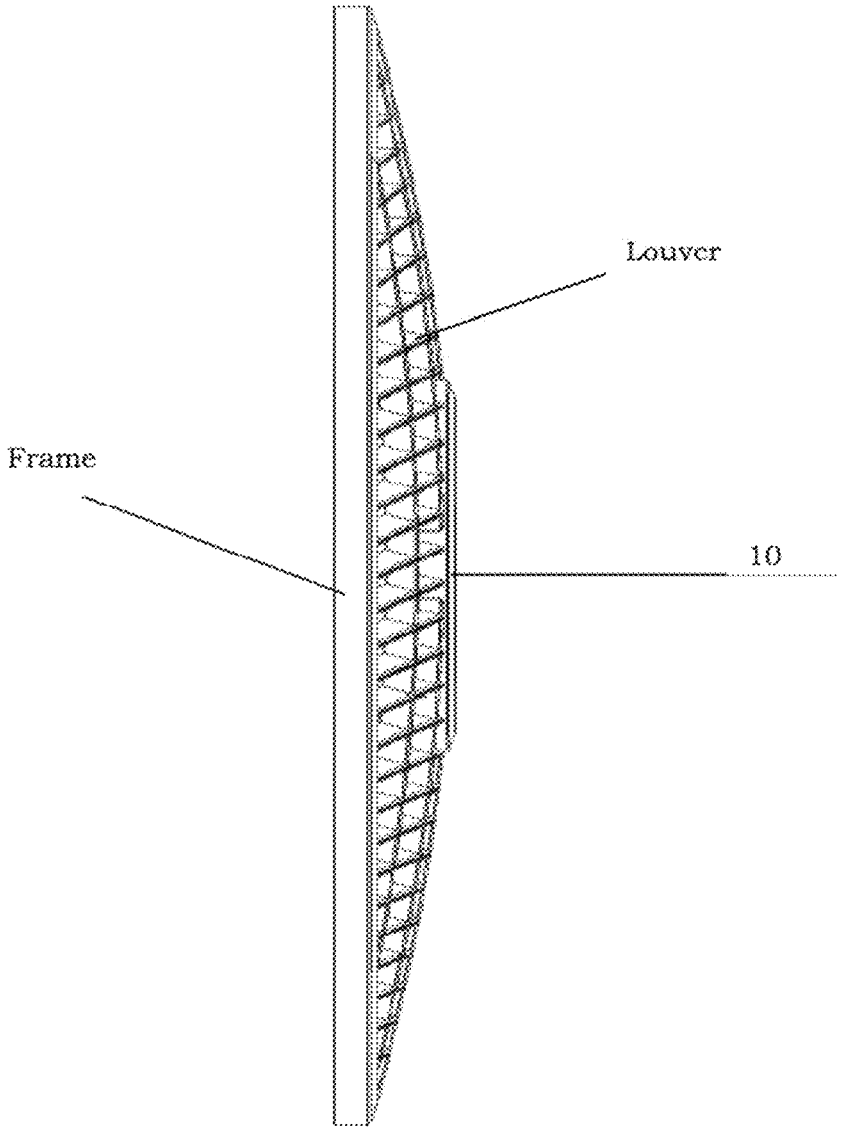
FIG. 4 is a side view of the fan grill of FIG. 2, in accordance with an example embodiment.

FIG. 4 is a side view of the fan grill of FIG. 2, in accordance with an example embodiment. The frame of the grill may be approximately flat. The louvers may be set within the frame. The louvers that are set within the frame may be bowed to extend slightly out of the frame, thus creating a somewhat rounded/bowed shape to the front of the grill (as shown in FIG. 4). Alternatively, the louvers may be set within the frame to be flat, such that the shape of the front of the grill may be flat (not shown). Notice that the 'centerline' 10 of the grill frame traverses through a midpoint of the grill frame.

Figure 5:
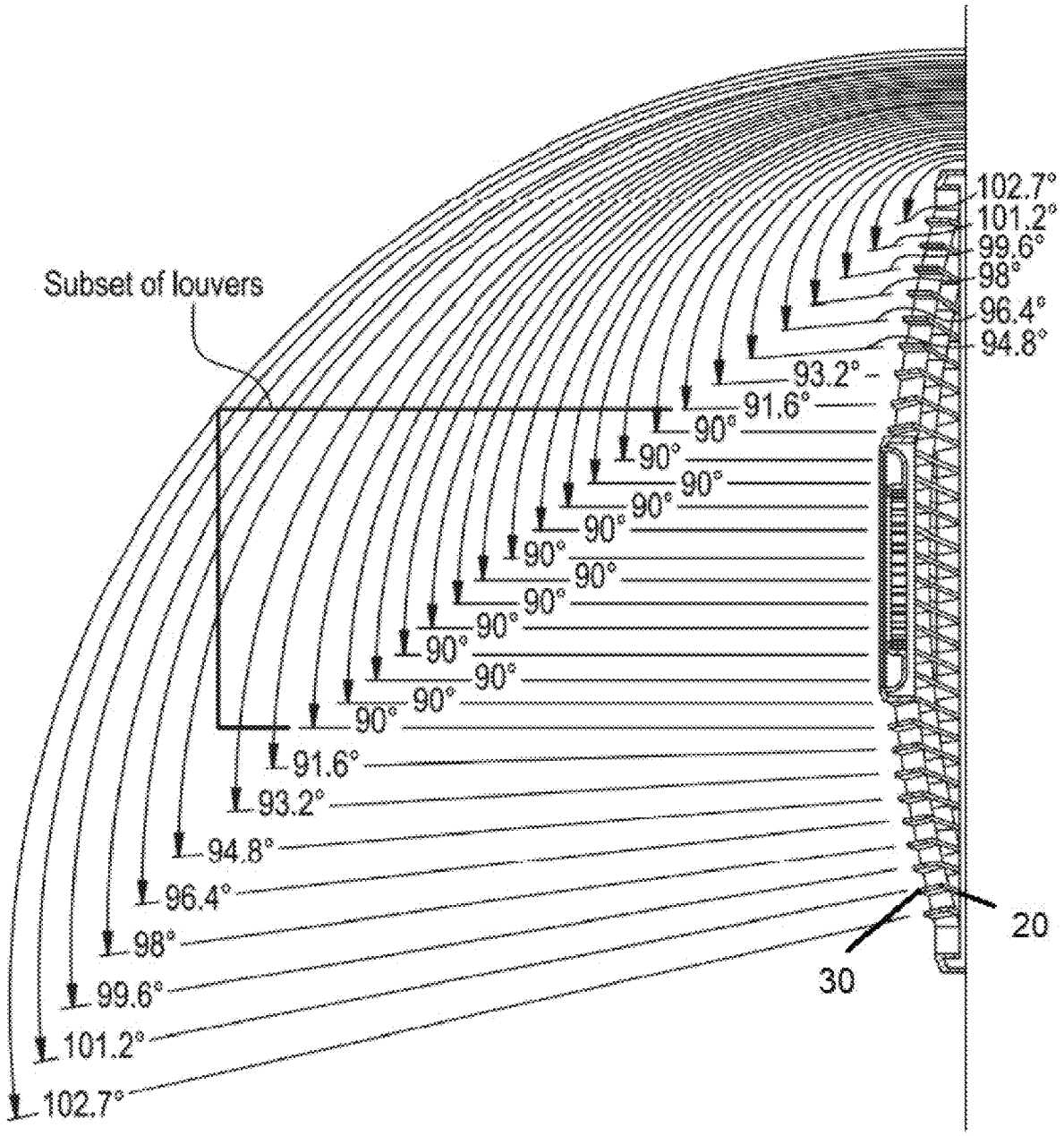
FIG. 5 is a side view of a fan grill showing varying louver angles, in accordance with an example embodiment.

FIG. 5 is a side view of a fan grill showing varying louver angles, in accordance with an example embodiment. Each of the louvers has an inlet edge 20 and an outlet edge 30, where the air flow traveling across the louvers flows from the inlet edge 20 to the outlet edge 30 when passing through the fan grill. The grill may include a subset of louvers with major surfaces that are angled to be about perpendicular (i.e., 90 degrees) relative to the flat surface of the grill frame. That is to say, these louvers are angled to be about parallel to the 'centerline' 10 of the grill frame (as shown in FIG. 4). The grill may also have other subsets of louvers with major surfaces that are angled to be something other than 90 degrees relative to the flat surface of the grill frame, as shown in FIG. 5.

As shown in FIG. 5, the louvers may each be angled between 90 degrees and 102.7 degrees relative to the flat surface of the grill frame. That is to say, some of the louvers may be offset from the louvers that are 90 degrees relative to the flat surface of the grill frame (in FIG. 5, the two louvers shown at the very top and bottom of the figure, labeled as 102.7 degrees, are therefore 'offset' by 12.7 degrees). The offset louvers may be angled such that the outlet edge 30 of each of the louvers are 'offset' in the same general direction (that is to say, in FIG. 5 the 'offset' louvers are each offset downwards). Alternatively, the outlet edge 30 of each of the offset louvers may be angled such that they are 'offset' in different directions (as in FIG. 8C, where the 'offset' louvers are angled both upward and downward, as described herein in more detail).

The offset louvers may be positioned at varying angles, and these angles may be slightly increased or decreased for offset louvers that are directly adjacent to any particular louver. This is shown in FIG. 5, where the top two louvers are 102.7 degrees and 101.2 degrees, and the next eight louvers below the top two louvers are gradually 'flared' upward. That is to say, in viewing FIG. 5, louver positions 1 and 2 (from the top) are 102.7 degrees. Louver position 3 is 99.6 degrees, louver position 4 is 98 degrees, louver position 5 is 96.4 degrees, louver position 6 is 94.8 degrees, louver position 7 is 93.2 degrees, and louver position 8 is 91.6 degrees (whereas louver positions 9-21 are all angled at 90 degrees). Louver positions 22-29 are offset louvers that flare out at varying angles from 91.6 degrees (at louver 22) up to 102.7 degrees (at louver 29). This gradual 'flaring out' of adjacent offset louvers helps to increase air flow currents that are traveling through the fan grill, in order to produce either a vortex-shaped air current (see FIG. 10) or a cone air current (FIG. 11) that significantly increases the effectiveness of a fan that is cooling a room. The gradual 'flaring' of the louvers may cause subsets of the louvers to each have unique 'offsets,' relative to each other (as in the subset of louvers 2 to 8, and as in the subset of louvers 22 to 29, shown on FIG. 5). The offset angle of these subsets of 'flared' louvers may progressively increase, from a first louver in a subset (which may have the slightest 'offset' angle) to a last louver in the subset (which may have a greatest 'offset' angle), such that the subset of 'flared' louvers is positioned in an 'ordered series' of louvers that possess a progressively greater offset angle, from one louver to the next.

It should also be noted that the surfaces of the louvers of the grill may each have a unique angle, such that none of the louvers share a common angle relative to the flat surface of the grill frame. Furthermore, it should be noted that none of the louvers have to be 90 degrees relative to the flat (horizontal) surface of the grill frame (such that all of the louvers may be 'offset' from 90 degrees, relative to the horizontal grill frame). Lastly, it should be understood that the extremely offset louvers (the louvers with the greatest 'offset' relative to the grill frame, shown as louvers 1, 2 and 29 in FIG. 5) may have a greater angle than 102.7 degrees. For instance, the extremely offset louvers may be angled up to 105 degrees or 110 degrees.

Figure 6:
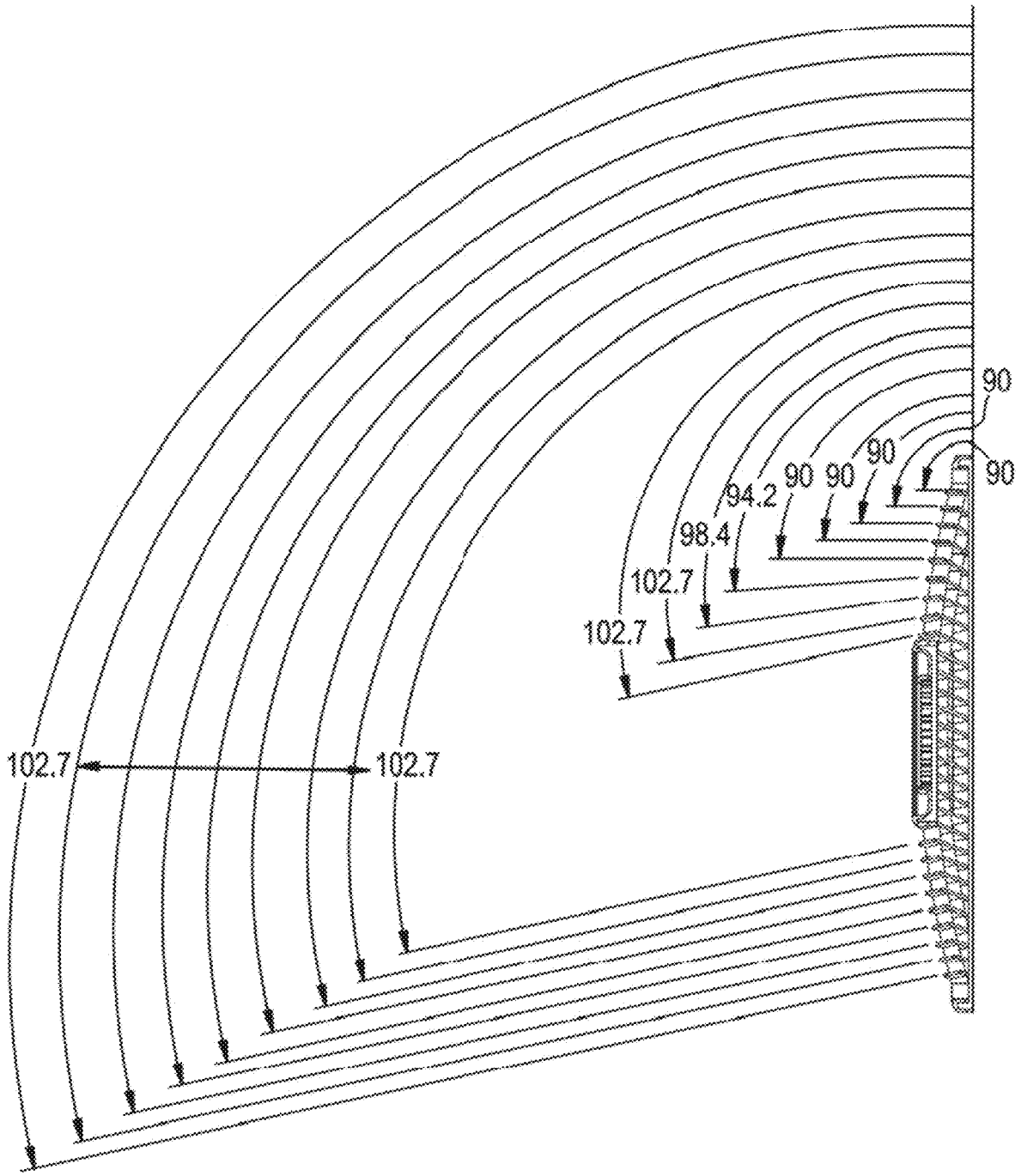
FIG. 6 is a side view of another fan grill showing varying louver angles, in accordance with an example embodiment.

FIG. 6 is a side view of another fan grill showing varying louver angles, in accordance with an example embodiment. In this embodiment, louvers 1-5 (from top) are each angled at 90 degrees. The next subset of louvers (louvers 6-9) have angles of 94.2, 98.4, 102.7 and 102.7 degrees. The bottom subset of louvers all have an angle of 102.7 degrees.

Figure 7:
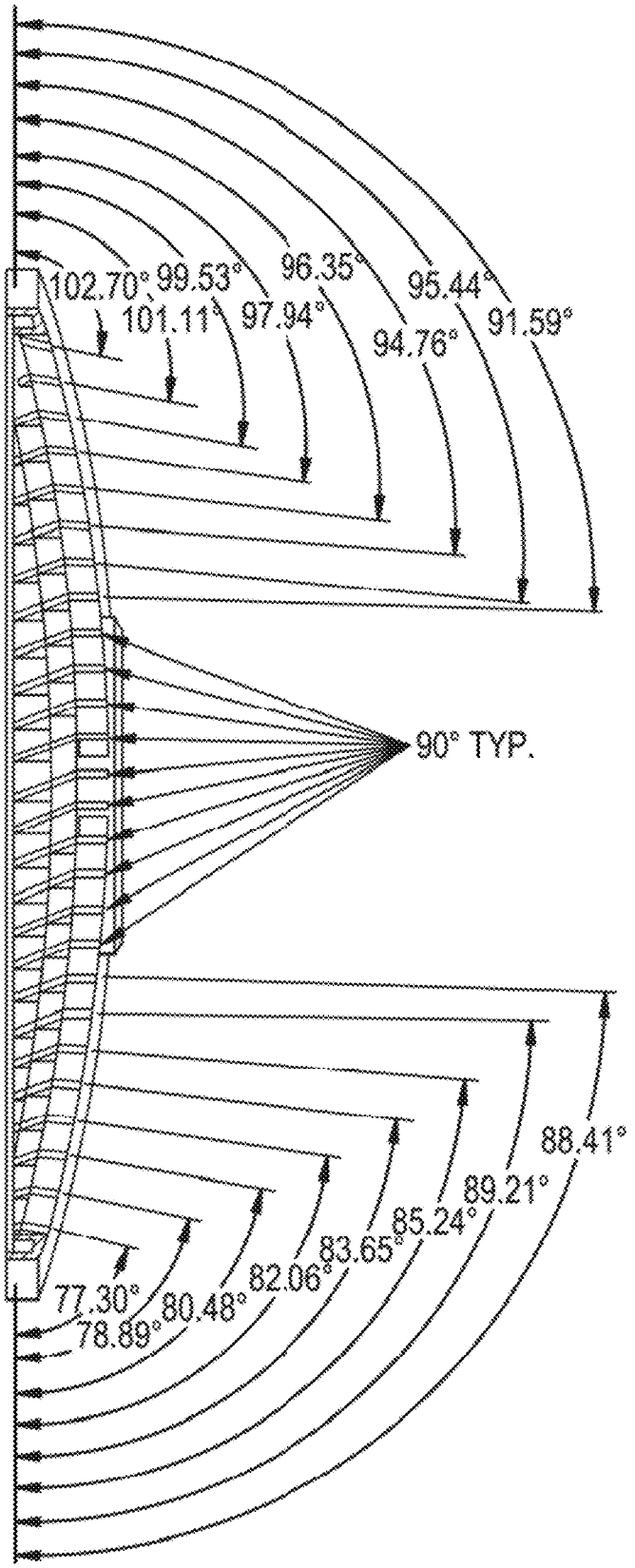
FIG. 7 is a side view of another fan grill showing varying louver angles, in accordance with an example embodiment.

FIG. 7 is a side view of another fan grill showing varying louver angles, in accordance with an example embodiment. In this figure, the offset louvers (louvers other than the middle subset of louvers set at 90 degrees) are again all angled downward.

Figure 8C:
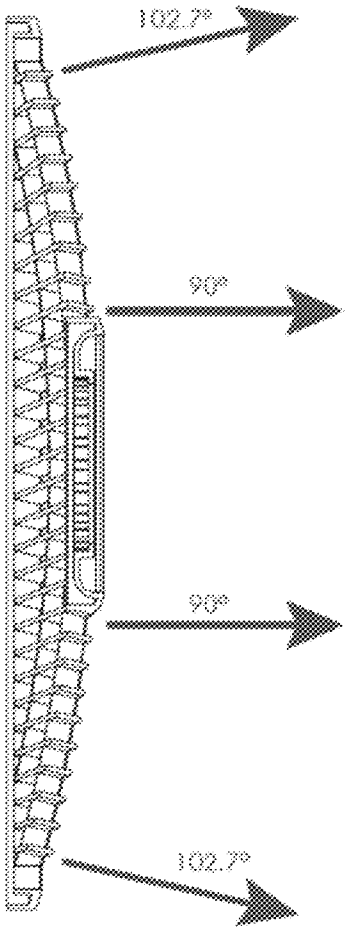
FIG. 8C is a side view of another fan grill showing varying louver angles, in accordance with an example embodiment.
Figure 8B:
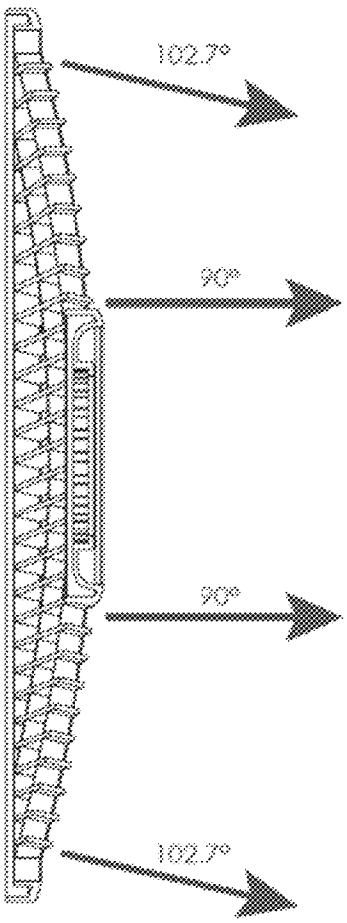
FIG. 8B is a side view of another fan grill showing varying louver angles, in accordance with an example embodiment.
Figure 8A:
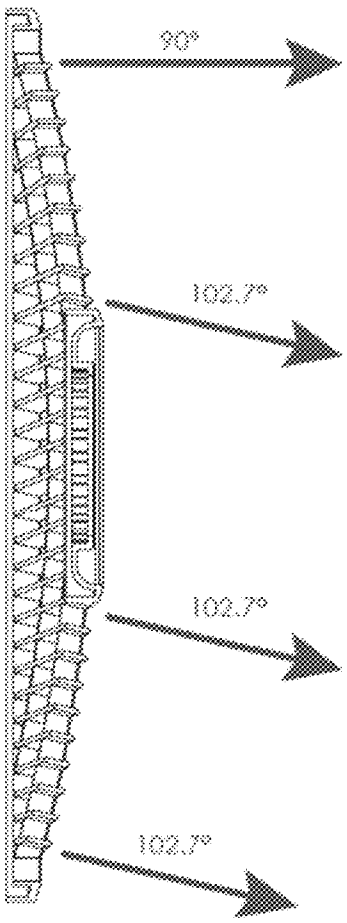
FIG. 8A is a side view of another fan grill showing varying louver angles, in accordance with an example embodiment.

FIGS. 8A-C are a side views of other fan grills, in accordance with an example embodiment. Note that FIG. 8C shows offset louvers (above and below the middle section of louvers set at 90 degrees) that are angled in different directions. That is to say, the offset louvers at the top of FIG. 8C are angled upward, whereas the offset louvers at the bottom of FIG. 8C are angled downward. Within FIG. 8C, it should be understood that the offset angles may each share a common angle. For example, the upper offset louvers may all be angled upward at 102.7 degrees (an offset angle of 12.7 degrees, angled upward relative to the center set of louvers), and the lower offset louvers may all be angled downward (an offset angle of 102.7 degrees, angled downward relative to the center set of louvers). Alternatively, the section of upper and lower offset louvers may be gradually 'flared out,' such that each adjacent louver may have a gradually increasing offset angle (leaving the extremely offset louvers at the very top and bottom of the grill).

Figure 9A:
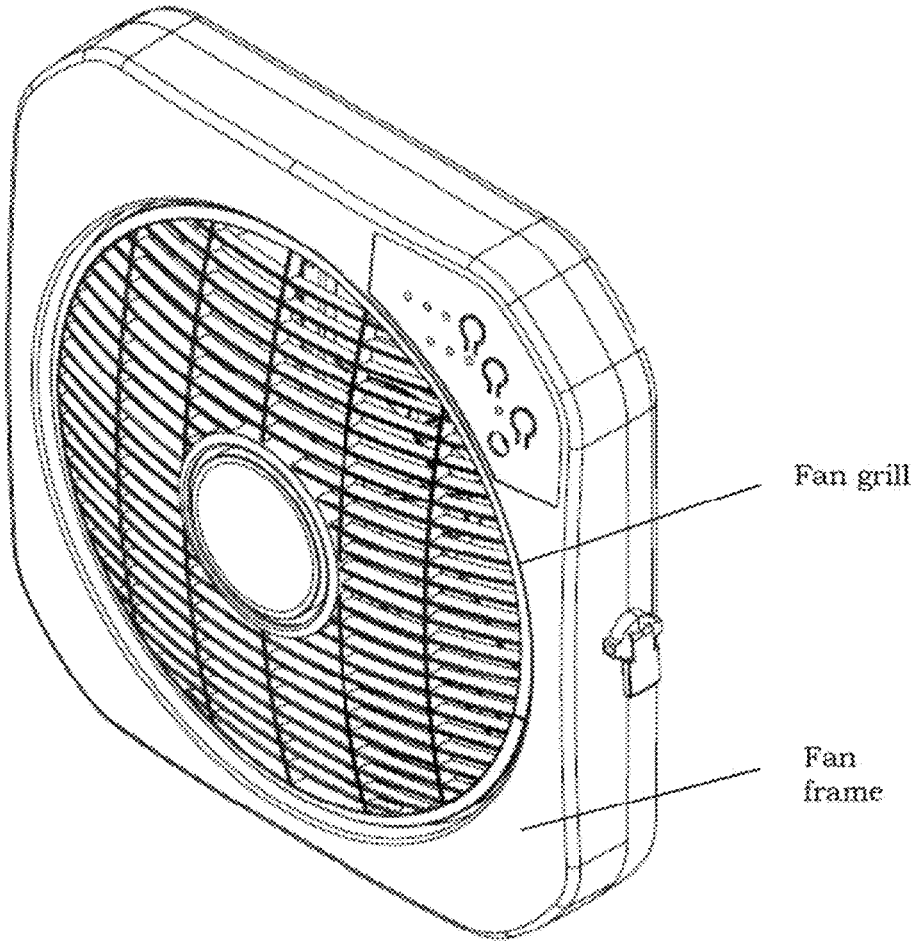
FIG. 9A is a perspective view of a fan with the fan grill, in accordance with an example embodiment.

FIG. 9A is a perspective view of a fan with the fan grill, in accordance with an example embodiment. The fan may include a fan frame that can be of varying size and shape (FIG. 9A shows a fan frame in a rectangular shape). The fan frame may hold the fan grill (described above).

Figure 9B:
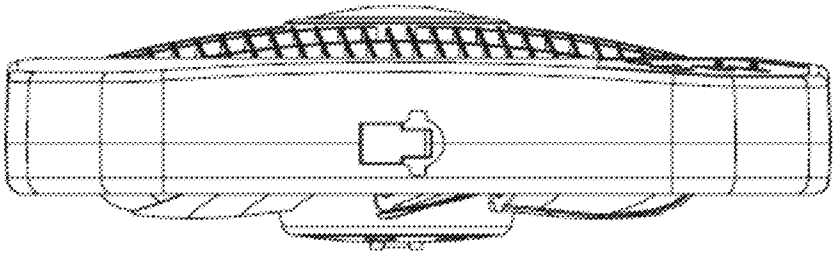
FIG. 9B is a side view of the fan of FIG. 9A, in accordance with an example embodiment.

FIG. 9B is a side view of the fan of FIG. 9A, in accordance with an example embodiment.

Figure 9C:
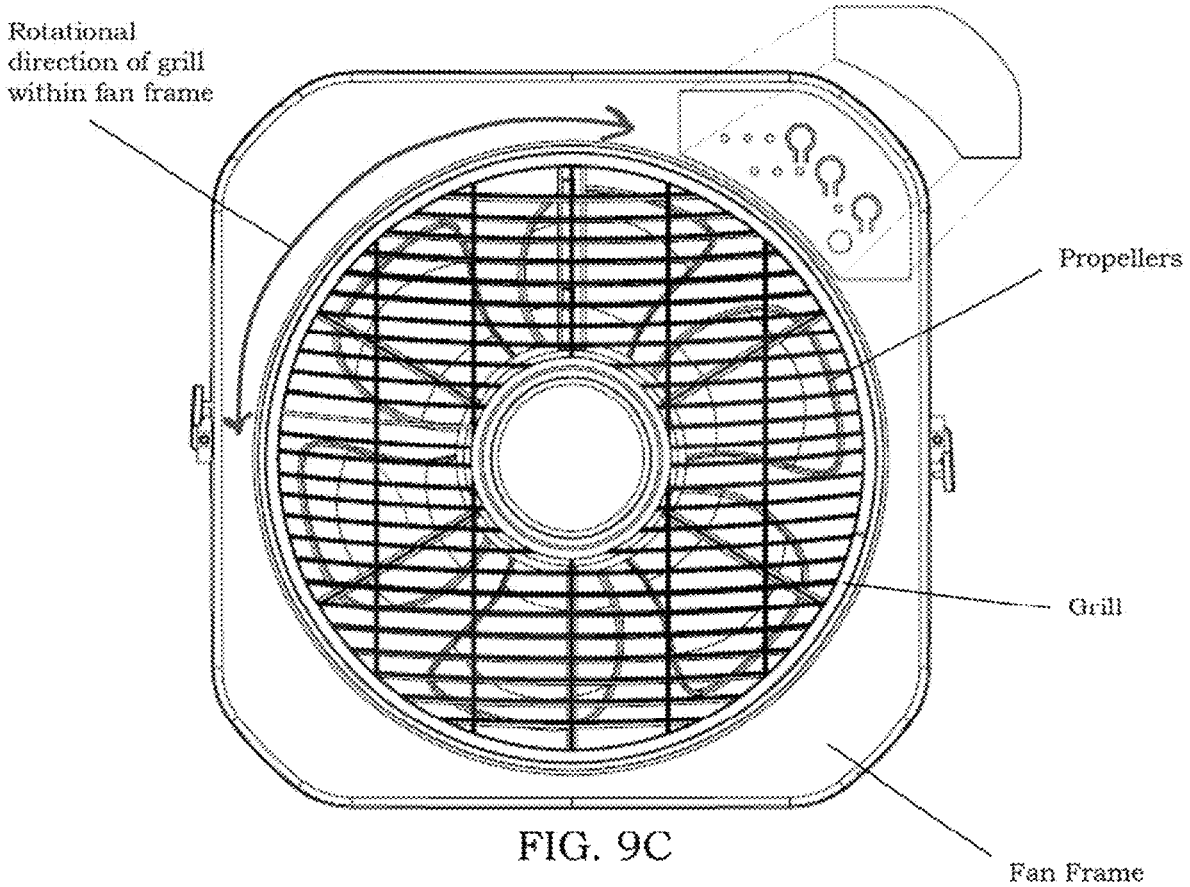
FIG. 9C is a front view of the fan of FIG. 9A, in accordance with an example embodiment.

FIG. 9C is a front view of the fan of FIG. 9A, in accordance with an example embodiment. The fan may have a fan motor (see FIG. 12A) driving the blades to create an air flow. The grill may be positioned in front of the blades. The fan may have a separate fan grill motor (see FIG. 12B) that rotates the grill within the fan frame, either clockwise or counter-clockwise (note the rotational direction of the grill within the frame, as shown in FIG. 9C). The added rotation of the grill within the fan frame may help to significantly increase the flow of air through the fan grill in order to spread air throughout an entire room (as shown in FIGS. 10 and 11).

Figure 10:
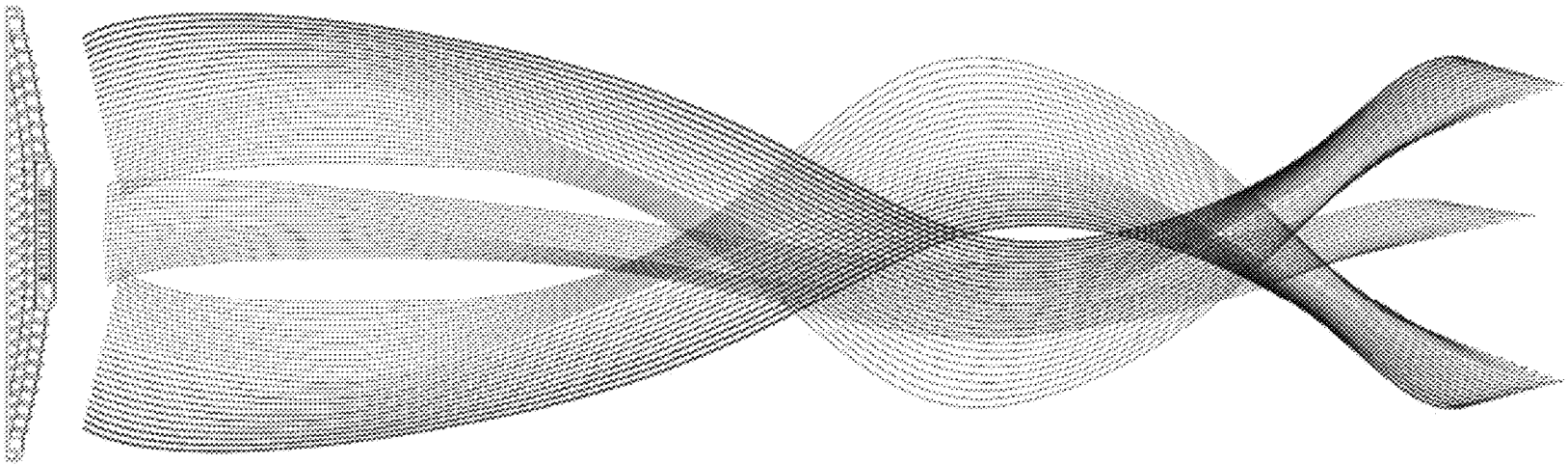
FIG. 10 is a diagram of a vortex-shaped air flow produced by a fan grill, in accordance with an example embodiment.

FIG. 10 is a diagram of a vortex-shaped air flow produced by a fan grill, in accordance with an example embodiment. This vortex-shaped air current may be produced by the fan of FIG. 9 that utilizes any of the grills (shown in FIGS. 5-7, and 8A-8B, in particular) with offset louvers that are angled in a same direction. That is to say, a vortex-shaped air current is formed when the offset louvers are each angled in a same direction (either upward, or downward, within the grill frame).

Figure 11:
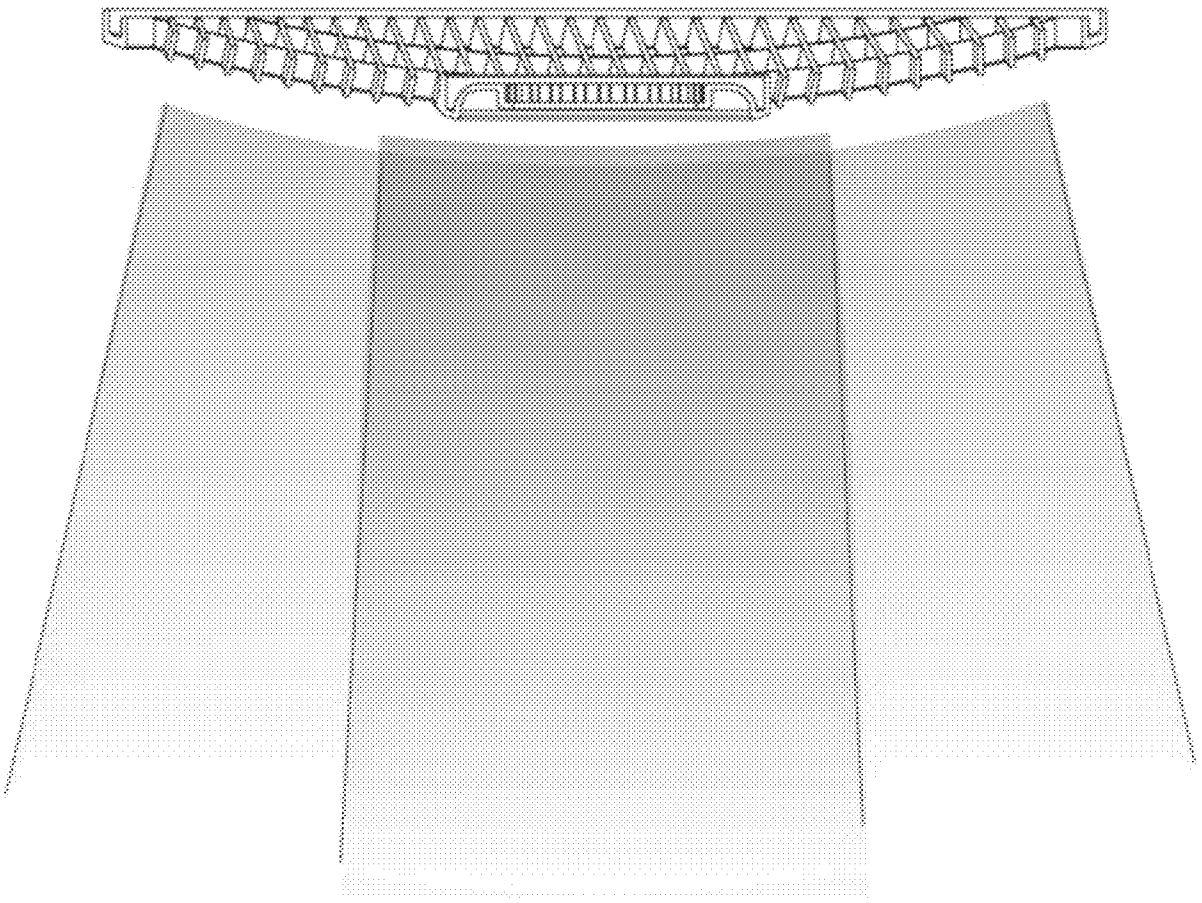
FIG. 11 is a diagram of a cone air flow produced by a fan grill, in accordance with an example embodiment.

FIG. 11 is a diagram of a cone air flow produced by a fan grill, in accordance with an example embodiment. This cone-shaped air current may be produced by the fan of FIG. 9 utilizes the grill of FIG. 8C with offset louvers that are angled in different directions. That is to say, the cone-shaped air current is formed when the offset louvers are angled to face both upward and downward within the grill frame.

Figure 12A:
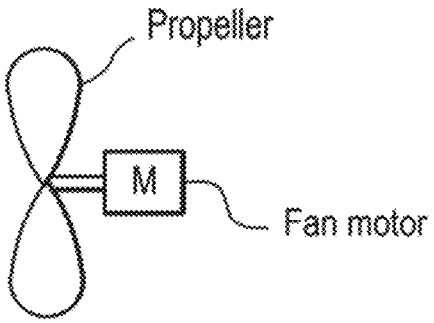
FIGS. 12A-B are diagrams of a fan motor and a fan grill motor, in accordance with an example embodiment.
Figure 12B:
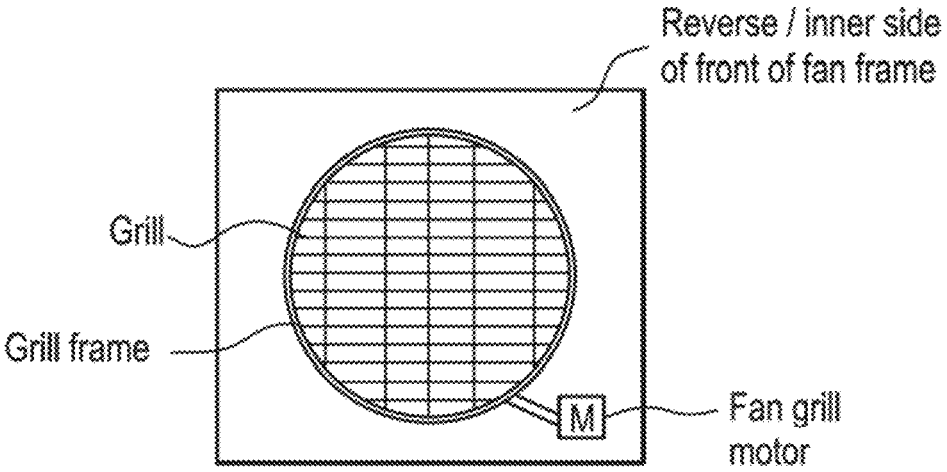

FIGS. 12A-B are diagrams of a fan motor and a fan grill motor, in accordance with an example embodiment. The fan motor may rotate the blades of the fan, and the fan grill motor may rotate the grill on the fan.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A fan, comprising:

a fan frame;

blades positioned inside the fan frame;

a grill frame on a side of the fan frame, the grill frame existing in a vertical plane, a centerline of the grill frame traversing through a midpoint of the grill frame and being perpendicular to the vertical plane, the grill frame having a first width;

a first motor configured to rotate the blades to produce an air flow in a first direction through the grill frame, the first direction being parallel to a centerline of the grill frame;

a second motor configured to rotate the grill frame in one of a clock-wise or a counter-clockwise direction within the fan frame; and a plurality of louvers affixed within the grill frame, each one of the plurality of louvers including an inlet edge and an outlet edge where the air flow passes from the inlet edge to the outlet when traveling through the grill frame in the first direction, the plurality of louvers including a first subset of louvers and a second subset of louvers, each of the plurality of louvers being substantially flat and having a longitudinal length spanning the first width, the plurality of louvers being parallel to each other, the first subset of louvers possessing no offset angle relative an angle of the centerline, the first subset of louvers being directly adjacent to each other without intervening louvers being in the first subset of louvers, the second subset of louvers having at least one first offset angle that deviates from the angle of the centerline, the outlet edge of each one of the second subset of louvers being angled toward a first side of the grill frame due to the at least one first offset angle, a first louver, of the second subset of louvers, being on a distal-most end of the grill frame on the first side, the first louver having a second offset angle that flares the outlet edge of the first louver in an outward direction away from the centerline, the second offset angle being a greatest offset angle relative to the other louvers of the plurality of louvers.

2. The fan of claim 1, wherein the second motor is configured to selectively and continuously rotate the grill frame in one of the clock-wise or the counter-clockwise direction within the fan frame.

3. The fan of claim 1, wherein at least some of the second subset of louvers possess unique offset angles.

4. The fan of claim 1, wherein each one of the second subset of louvers possess unique offset angles.

5. The fan of claim 1, wherein the at least one offset angle successively and incrementally increases for each one of the second subset of louvers.

6. The fan of claim 1, wherein the at least one offset angle successively and incrementally increases for each one of the second subset of louvers, from a second louver to the first louver, of the second subset of louvers.

7. The fan of claim 6, wherein the second louver is directly adjacent to the first subset of louvers.

8. The fan of claim 7, wherein the outlet edge of the second subset of louvers are angled away from the first subset of louvers.

9. The fan of claim 1, wherein the second offset angle is 12.7 degrees.

10. The fan of claim 1, wherein the first subset of louvers include a total of five louvers.

11. The fan of claim 1, wherein the plurality of louvers include a total of 29 louvers.

12. The fan of claim 11, wherein the first subset of louvers include a total of five louvers.

13. The fan of claim 1, wherein the first subset of louvers is on a second side of the grill frame, the first side and the second side being on opposite sides of the grill frame.

14. The fan of claim 13, wherein each one of the second subset of louvers possess unique offset angles.

15. The fan of claim 14, wherein the at least one offset angle successively and incrementally increases for each one of the second subset of louvers.

16. The fan of claim 14, wherein the at least one offset angle successively and incrementally increases for each one of the second subset of louvers, from a second louver to the first louver, of the second subset of louvers.

17. The fan of claim 16, wherein the second louver is directly adjacent to the first subset of louvers.

18. The fan of claim 17, wherein the second offset angle is 12.7 degrees.

19. The fan of claim 13, wherein the outlet edge of the second subset of louvers are angled away from the first subset of louvers.

20. The fan of claim 1, wherein the fan frame is free-standing.

* * * * *